US005680161A

United States Patent [19]

Lehman et al.

[11] Patent Number: 5,680,161

[45] Date of Patent: Oct. 21, 1997

[54] METHOD AND APPARATUS FOR HIGH SPEED GRAPHICS DATA COMPRESSION

[75] Inventors: Leonard A. Lehman, Redwood City; George W. Lambidakis, Aptos, both of Calif.

[73] Assignee: Radius Inc., Sunnyvale, Calif.

[21] Appl. No.: 928,261

[22] Filed: Aug. 11, 1992

Related U.S. Application Data

[63] Continuation-in-part of Ser. No. 679,760, Apr. 3, 1991, abandoned.

[51] Int. Cl.[6] ..... G09G 5/00

[52] U.S. Cl. ..... 345/190; 345/200

[58] Field of Search ..... 360/798, 799, 360/750; 382/56; 345/185, 186, 189, 201, 192, 190, 200; 395/166

[56] References Cited

U.S. PATENT DOCUMENTS

| | | | |
|---|---|---|---|
| 3,974,493 | 8/1976 | de Cavaignac et al. | 340/324 AD |
| 4,368,466 | 1/1983 | Dwire | 340/799 |
| 4,862,154 | 8/1989 | Gonzalez-Lopez | 340/747 |
| 4,868,557 | 9/1989 | Perlman | 340/799 |
| 4,884,069 | 11/1989 | Farand | 340/799 |
| 5,269,003 | 12/1993 | Roskowski et al. | 395/166 |

OTHER PUBLICATIONS

Macintosh Display Cards 4●8 and 8●24, Developer Note, Apr. 2, 1990, pp. 1 – 32, Developer Technical Publications, Apple Computer, Inc.

*Primary Examiner*—Richard Hjerpe

*Attorney, Agent, or Firm*—Limbach & Limbach LLP

[57] ABSTRACT

A method and apparatus for controlling the display of graphics data, in which the data are compressed for dense storage in a graphics memory. The densely packed data can be asynchronously read from the memory and reformatted into a format suitable for driving a conventional display device. The memory comprises an array of memory locations, each location having capacity to store a first number of bits. The apparatus includes a graphics controller capable of densely packing compressed data words into the memory locations, where each compressed word comprises a second number of bits corresponding to a pixel. The graphics controller can densely pack the compressed words in the sense that it can write both a first word and a first portion of a second word into one memory location, and a second portion of the second word (with at least a portion of a third word) in a second memory location. In preferred embodiments, the apparatus of the invention receives 32-bit video data (with corresponding host addresses) and compresses each 32-bit word into a 24-bit pixel for dense packing in a video memory having 32-bit memory locations.

6 Claims, 11 Drawing Sheets

| | $CAS_0$ | $CAS_1$ | $CAS_2$ | $CAS_3$ |
|---|---|---|---|---|
| 0 | $\alpha_0$ | $R_0$ | $G_0$ | $B_0$ |
| 1 | $\alpha_1$ | $R_1$ | $G_1$ | $B_1$ |
| 2 | $\alpha_2$ | $R_2$ | $G_2$ | $B_2$ |
| 3 | $\alpha_3$ | $R_3$ | $G_3$ | $B_3$ |
| 4 | $\alpha_4$ | $R_4$ | $G_4$ | $B_4$ |
| 5 | $\alpha_5$ | $R_5$ | $G_5$ | $B_5$ |
| 6 | $\alpha_6$ | $R_6$ | $G_6$ | $B_6$ |
| 7 | $\alpha_7$ | $R_7$ | $G_7$ | $B_7$ |
| 8 | $\alpha_8$ | $R_8$ | $G_8$ | $B_8$ |
| 9 | $\alpha_9$ | $R_9$ | $G_9$ | $B_9$ |
| 10 | $\alpha_{10}$ | $R_{10}$ | $G_{10}$ | $B_{10}$ |
| 11 | $\alpha_{11}$ | $R_{11}$ | $G_{11}$ | $B_{11}$ |

• • •

FIG. 1
(PRIOR ART)

| MA | $CAS_0$ | $CAS_1$ | $CAS_2$ | $CAS_3$ | BLOCK |
|---|---|---|---|---|---|
| 0 | R0 | G0 | B0 | R1 | 0 |
| 1 | G1 | B1 | R2 | G2 | |
| 2 | B2 | R3 | G3 | B3 | |
| 3 | R4 | G4 | B4 | R5 | 1 |
| 4 | G5 | B5 | R6 | G6 | |
| 5 | B6 | R7 | G7 | B7 | |
| | | | | | |
| | Rn | Gn | Bn | R(n+1) | n/4 |
| | G(n+1) | B(n+1) | R(n+2) | G(n+2) | |
| | B(n+2) | R(n+3) | G(n+3) | B(n+3) | |
| 262,143 | | | | | |

FIG. 2

| PIXELS IN MEMORY | | | | PIXELS OUTPUT FROM LOGIC DEVICE |
|---|---|---|---|---|
| $R_N$ | $G_N$ | $B_N$ | $R_{N+1}$ | OUTPUT PIXEL N AND STORE $R_{N+1}$ |
| $G_{N+1}$ | $B_{N+1}$ | $R_{N+2}$ | $G_{N+2}$ | OUTPUT PIXEL N+1 AND STORE $R_{N+2}$ AND $G_{N+2}$ |
| $B_{N+2}$ | $R_{N+3}$ | $G_{N+3}$ | $B_{N+3}$ | OUTPUT PIXEL N+2 AND STORE $R_{N+3}$, $G_{N+3}$ AND $B_{N+3}$ |
| | | | | OUTPUT PIXEL N+3 |

PIXEL PACKED MEMORY WRITE

PIXEL PACKED MEMORY READ

| MEMORY ACCESSES AS A FUNCTION OF GROUP | | | | |
|---|---|---|---|---|
| GROUP | CYCLES | FIRST WRITE ENABLES | SECOND WRITE ENABLES | DATA ORGANIZATION |
| 0 | 1 | 1110 | | RGBX |
| 1 | 2 | 0001 | 1100 | GBXR |
| 2 | 2 | 0011 | 1000 | BXRG |
| 3 | 1 | 0111 | | XRGB |

| MEMORY ACCESSES AS A FUNCTION OF GROUP | | | | |
|---|---|---|---|---|
| GROUP | CYCLES | FIRST WRITE ENABLES | SECOND WRITE ENABLES | DATA ORGANIZATION |
| 0 | 1 | 1110 | | RGBX |
| 1 | 2 | 0001 | 1100 | GBXR |
| 2 | 2 | 0011 | 1000 | BXRG |
| 3 | 1 | 0111 | | XRGB |

METHOD AND APPARATUS FOR HIGH SPEED GRAPHICS DATA COMPRESSION

CROSS-REFERENCE TO RELATED APPLICATION

This application is a continuation-in-part of U.S. patent application Ser. No. 07/679,760, filed Apr. 3, 1991, now abandoned.

FIELD OF THE INVENTION

This invention relates to the field of controlling a graphical video display. More particularly, this invention relates to a method and apparatus for high speed graphic data compression.

BACKGROUND OF THE INVENTION

A video graphics system typically includes a display, such as a video display monitor, a controller circuit and a video memory. As is well known, typical monitors are comprised of an array of pixels that are illuminated by an electron beam. The memory contains sufficient data to instruct the beam relative to the illumination of each pixel.

Each pixel can be controlled by a single memory bit for monochromatic displays or by multiple bits for an improved image and by providing sufficient control for various shades of gray or colors. The more bits used to define the pixel the better the quality of the image. Image quality can also be improved by increasing the number of pixels per unit of area on the display screen.

The amount of memory used in a system directly affects the cost of the system because of two related considerations. First, more memory requires additional memory circuits be purchased. Typically, video random access memory integrated circuits (VRAMs) are used in these types of applications because they are designed to provide the memory in a manner suitable for video. Additional circuits require additional capital expense for each system. Second, the additional VRAMs require additional printed circuit board space be used for the memory portion of the circuit. As is well known, "real estate" is always at a premium in electronic systems. Thus, minimizing the amount of memory to achieve the intended result is always desirable.

There are several types of standard video displays each having one of a predetermined number of rows and columns of pixels and each pixel requiring a particular number of bits of display data to control illumination. For example, with an APPLE MACINTOSH computer there are applications programs that require 1, 2, 4, 8 and 24 bits per pixel. The 24 bits per pixel mode includes 8 bits each to separately control the intensity of red, green and blue. (APPLE and MACINTOSH are trademarks of Apple Computer Corporation.)

The MACINTOSH expects video data in 32 bit words. In the 1, 2, 4 and 8 bit modes, the 32 bit words are divided equally into control for 32, 16, 8 and 4 pixels, respectively. Because the MACINTOSH expects multiple control per 32 bit word retrieved, it automatically divides the word into an appropriate number of control pixels to draw the display screen. However, because no more than one 24 bit control word can fit in a conventional 32 bit memory location, conventional graphics systems (operating in a 24 bits per pixel mode) waste 8 bits per word for each memory location.

FIG. 8 is a block diagram of a conventional graphics system of this type, which makes wasteful use of video memory. The FIG. 8 system supports a 640 pixel by 480 pixel ("640×480") display in which each pixel consists of 24 bit color data (an 8 bit red value, an 8 bit green value, and an 8 bit blue value). To refresh the display, pixels are read sequentially from frame buffer memory 5 (comprising VRAM circuits 4, 6, and 8, and shift registers 4A, 6A, and 8A) under control of video shift register 10 (e.g., in response to a shift clock SCLK asserted from circuit 10 to shift registers 4A, 6A, and 8A of frame buffer 5). Video shift register 10 provides the red, blue, and green pixels read out from the frame buffer memory to RAMDAC (random access memory digital-to-analog conversion) circuit 12 (in response to a pixel clock DOTCK asserted from circuit 10 to RAMDAC 12). RAMDAC circuit 12 converts the pixels into voltage values for driving the display device (e.g., for controlling the intensity of red, green, and blue CRT beams if the display device is a cathode ray tube display). The display is refreshed at a desired rate, typically in the range from 25 times per second to over 75 times per second. The process of reading pixels from the frame buffer memory to "repaint" a display screen is known as a "display refresh" operation.

Graphics controller 2 shown in FIG. 8 receives 32-bit video data over bus 1 from a host computer (not shown), and controls the writing of color pixels of the 32-bit data to the frame buffer. Graphics controller 2 assumes that 24 bits (typically the 24 least significant bits) of each 32-bit word received over bus 1 represents a color pixel, and asserts appropriate internal memory address signals, and control signals (including row and column address strobe signals) to the frame buffer memory to latch each color pixel into a different memory location within the frame buffer.

Graphics controller 2 also asserts appropriate address and control signals to frame buffer ("frame store") 5 and to RAMDAC 12, to perform a display refresh operation.

In the FIG. 8 system, frame store 5 comprises VRAMs 4, 6, and 8 and shift registers 4A, 6A, and 8A, and has capacity to hold all 24 bit values for updating a 640×480 pixel color display (i.e., 307,200 values, each consisting of 24 bits). The powers of two nearest to the number 307,200 are 262,144 (referred to in the industry, and in this disclosure, as "256K") and 524,288 (referred to in the industry, and in this disclosure, as "512K"). The conventional technique for storing a frame of 307,200 (24-bit) pixel values employs a memory having at least 307,200 memory locations, each location having 24-bit capacity (i.e., a stack of at least 307,200 locations, each having 24-bit width). Because the capacities of inexpensive conventional memory circuits are powers of two, and because the smallest power of two which exceeds 307,200 is 524,288 ("512K"), the frame buffer memory of the FIG. 8 system is implemented with one or more chips having a total capacity of 512K×24 bits. Typically, each of VRAMs 4, 6, and 8 in the FIG. 8 system has 512K×8 bit capacity, and each VRAM is implemented with four identical memory chips, each of 256K×4 bit capacity, so that a total of twelve 256K×4 bit chips are required to implement the frame buffer memory of FIG. 8.

However, because a total of only 921,600 bits (307,200 24-bit pixel values) are needed to update a 640×480 pixel color display, 651,264 bits of the FIG. 8 frame buffer memory (which has 1,572,864 bit capacity) are wasted.

FIG. 8A is a block diagram of another conventional graphics system. The FIG. 8A system supports a 640 pixel by 480 pixel ("640×480") display in which each pixel consists of 24 bit color data (an 8 bit red value, an 8 bit green value, and an 8 bit blue value). The FIG. 8A system differs from that of FIG. 8 in that its frame store 5A comprises four VRAM circuits (each implemented as a 512K×8 bit VRAM chip) rather than three (as in FIG. 8), and one shift register for each of the four VRAM circuits.

Graphics controller 2 of FIG. 8A receives 32-bit video data (each 32-bit video word comprising an α byte, a red byte, a green byte, and a blue byte) over bus 1 from a host computer and controls the writing of each entire 32-bit data to frame store 5A. 32-bit words are sequentially read out from frame store 5A into circuit 10 (under control of circuit 10), but only 24 bits of each such word (the red, green, and blue bytes thereof) are output from circuit 10 to RAMDAC 12 for refreshing the display. Thus, because a total of only 921,600 bits (307,200 24-bit pixel values) are needed to refresh a 640×480 pixel color display, 1,175,552 bits of frame store 5A of FIG. 8A (which has a total 2,097,152 bit capacity) are wasted.

SUMMARY OF THE INVENTION

The invention is a method and apparatus for controlling the display of graphics data, in which the data are compressed for dense storage in a graphics memory. The densely packed data can be asynchronously read from the memory and reformatted into a format suitable for driving a conventional display device. The memory comprises an array of memory locations, each location having capacity to store a first number (N) of bits. The apparatus includes a graphic controller capable of densely packing compressed data words into the memory locations, where each compressed word comprises a second number (M) of bits corresponding to a pixel (where M does not equal N). The graphic controller can densely pack the compressed words in the sense that it can write both a first word and a first portion of a second word into one memory location, and a second portion of the second word (with at least a portion of a third word) in a second memory location.

In a class of preferred embodiments, the apparatus of the invention receives 32-bit video data from a host (with corresponding host addresses), and compresses each 32-bit host word into a 24-bit color pixel for dense packing in a video memory having 32-bit memory locations. Each pixel represents an 8 bit red value $R_i$, an 8 bit green value $G_i$, and an 8 bit blue value $B_i$, where i is an integer representing a host address for the pixel. In one such embodiment, the video memory consists of VRAM circuitry having 256K×32 bit capacity, and the graphics controller causes the 24-bit pixels to be written into the frame buffer in the following sequence: the 32-bit sequence $R_1G_1B_1R_2$ is written into a first memory location, the 32-bit sequence $G_2B_2R_3G_3$ is then written into the next memory location, the 32-bit sequence $B_3R_4G_4B_4$ is then written into a third memory location, and so on.

Preferably, the graphics controller includes data router circuitry for reformatting each 32-bit host data word into a format suitable for accomplishing dense packing in the video memory, and a display refresh controller. The invention employs a first clock signal (shift clock) to read each 32-bit word from a memory location in the video memory into a pixel buffer within a video shift register circuit, and a second clock signal (pixel clock) for clocking each 24-bit pixel from an output register in the video shift register circuit into a RAMDAC. The shift clock (signal "SCLK") is generated from the pixel clock ("OSCin" or "DOTCK") by periodically suppressing a pulses of the pixel clock.

The analog voltage signals output from the RAMDAC drive a video display having a plurality of pixels arranged in a sequence which maps one to one onto a sequence of internal addresses within the video memory. Each such internal address corresponds to a portion (e.g., a 24-bit portion) of a memory location (e.g., a 32-bit memory location).

BRIEF DESCRIPTION OF THE DRAWINGS

FIG. 1 is a representation of a prior art data storage means.

FIG. 2 is a representation of a data storage means in which data have been stored in accordance with the present invention.

FIG. 14 is a timing diagram representing signals received by the FIG. 13 apparatus during operation and signals generated during operation of the FIG. 13 apparatus.

DETAILED DESCRIPTION OF THE PREFERRED EMBODIMENT

Figures 3, 4:
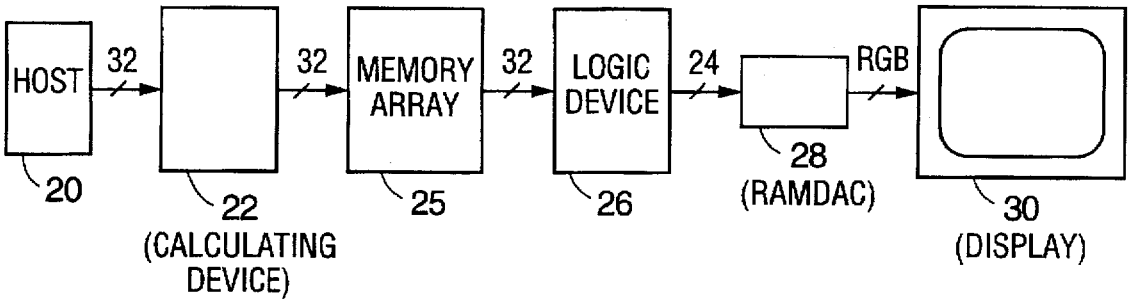
FIG. 3 is a block diagram of a preferred embodiment of the present invention.
FIG. 4 is a diagram representing data storage into memory, and data output from memory, in accordance with the invention.

The present invention will be described relative to a preferred embodiment, in particular, for use with a MACINTOSH computer. However, it will be appreciated by a person of ordinary skill in the art that the invention may be applied to other types of systems requiring similar control for their video graphics.

In a typical MACINTOSH application, the graphics display memory is organized to store 32 bit words. This allows the computer to select pixel sizes of 1, 2, 4, 8, 16 and 24 bit words. In the 24 bit graphics mode, each pixel consists of an 8 bit red value, an 8 bit green value, and an 8 bit blue value.

The MACINTOSH specifications indicate that for future applications, a 32 bit wide graphics mode is anticipated. A 32-bit word is defined as one pixel, comprising α, R, G, and B color components. The 32 bits are used 8 bits at a time: 8 α bits (for example, 8-bit word $\alpha_0$ shown in FIG. 1), 8 bits for red (for example, 8-bit word $R_0$ shown in FIG. 1), 8 bits for green (for example, 8-bit word $G_0$ shown in FIG. 1), and 8 bits for blue (for example, 8-bit word $B_0$ shown in FIG. 1). The α channel is part of the pixel but not part of the color components normally displayed.

With reference to FIG. 1, the memory location identified by address 0 (the top "row" in FIG. 1) holds the 8 bits $\alpha_0$ which have been written into the first "bank" of the memory location during assertion of column enable signal $CAS_0$, 8 bits $R_0$ for controlling the intensity of red to be displayed in pixel 0 (the first pixel in the first row of the display) which have been written into the second bank of the memory location during assertion of column enable signal $CAS_1$, 8 bits $G_0$ (for controlling the intensity of green to be displayed in pixel 0) which have been written into the third bank of the memory location during assertion of column enable signal $CAS_2$, and 8 bits $B_0$ (for controlling the intensity of blue to be displayed in pixel 0) which have been written into the fourth bank of the memory location during assertion of column enable signal $CAS_3$. This mode of storing the data is continued throughout the other memory locations of a conventional memory having the organization shown in FIG. 1. Twelve memory locations identified by addresses 0–11 are indicated in FIG. 1, although conventional implementations of a memory having such organization (for example, the frame buffer memory of FIG. 8) have a total of 524,288 of such memory locations, each having 32-bit capacity).

Many display applications do not require α-channel bits to be written into memory for use in refreshing a screen display. In such applications, it is conventional to select 24 bits of each 32-bit data word (the red, green, and blue 8-bit channels, but not the 8-bit α-channel), and write only the selected 24 bits to a 32-bit memory location, thus wasting 8 bits of each memory location.

Because memory is expensive and uses valuable board space, it is desirable to use as little memory as possible. Utilizing the present invention, pixels are compressed and densely packed into a memory, so that they can be read out and reformatted as needed to refresh a display. A preferred embodiment of the invention accomplishes this by employing a memory organization of the type shown in FIG. 2. As shown in FIG. 2, a first compressed pixel (comprising 8-bit byte $R_0$, 8-bit byte $G_0$, and 8-bit byte $B_0$) is written to memory address 0 (the top "row" of FIG. 2 identified by address MA 0), but portions of subsequent compressed pixels, such as the second compressed pixel (comprising 8-bit byte $R_1$, 8-bit byte $G_1$, and 8-bit byte $B_1$), are written into two different memory locations. Specifically, byte $R_0$ is written into the first "column" of memory location 0 during assertion of a column enable signal $CAS_0$, byte $G_0$ is written into the second column of memory location 0 during assertion of a second column enable signal $CAS_1$, byte $B_0$ is written into the third column of memory location 0 during assertion of a third column enable signal $CAS_2$, byte $R_1$ (i.e. a first portion of the second compressed pixel) is written into the fourth column of memory location 0 during assertion of a fourth column enable signal $CAS_3$, byte $G_1$ is then written into the first "column" of the memory location 1 (the next location, having internal memory address "1") during the next assertion of column enable signal $CAS_0$, byte $B_1$ is written into the second column of memory location 1 during the next assertion of column enable signal $CAS_1$, byte $R_2$ is written into the third column of memory location 1 during the next assertion of column enable signal $CAS_2$, and so on.

Figure 9:
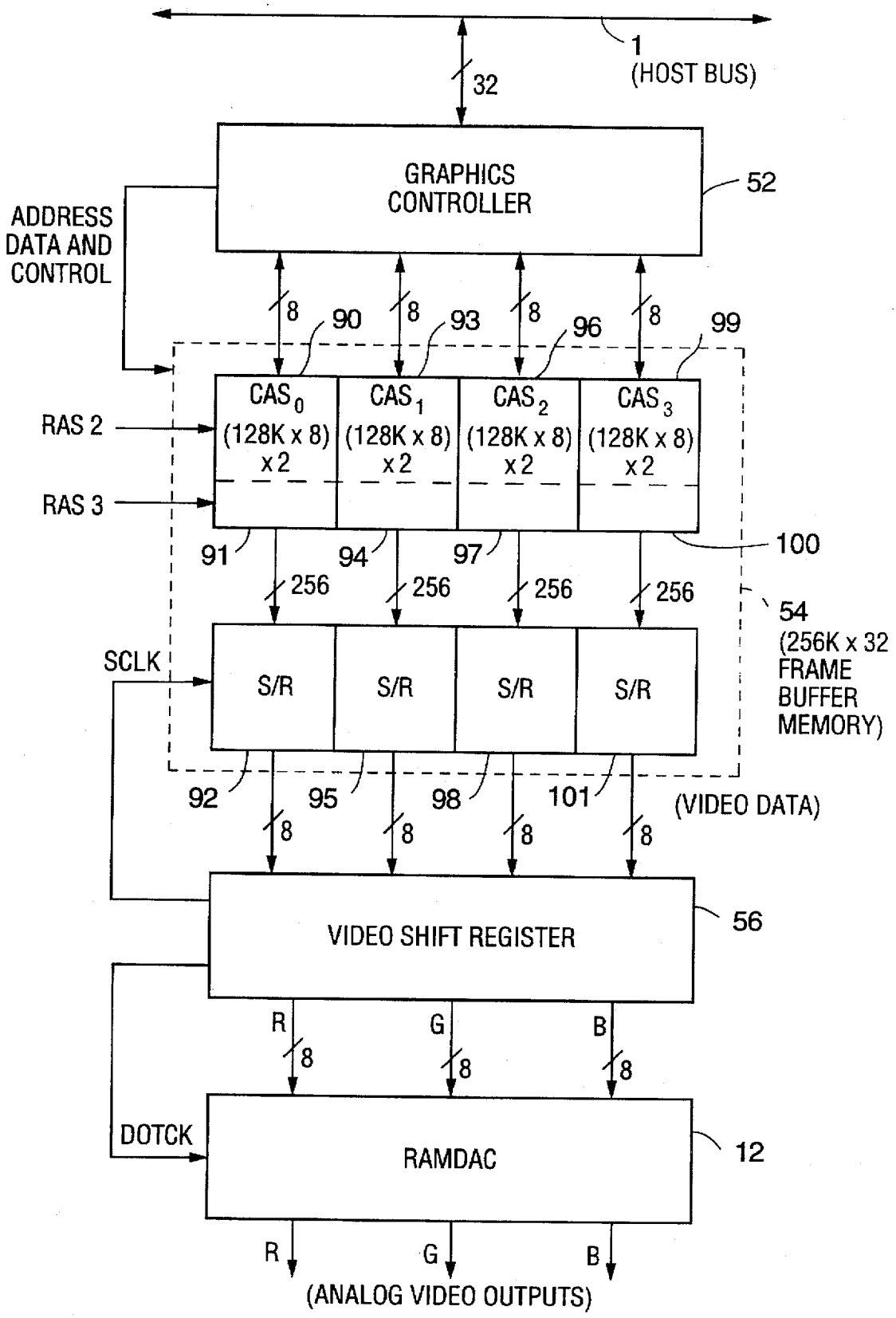
FIG. 9 is a block diagram of a preferred embodiment of the graphics system of the invention.

The host address provided by the host over bus 1 in the FIG. 9 embodiment of the invention is a byte address to a 32-bit wide memory, where each 32-bit word represents one 24-bit pixel. The host assumes that the upper (8-bit) byte of each 32-bit memory location is wasted, so that each 32-bit word from the host has format XRGB, where X is a wasted 8-bite byte (having host address N), and R, G, and B (having host addresses N+1, N+2, and N+3, respectively) together represent a 24-bit pixel. In accordance with the invention, each 24-bit pixel (or 8-bit or 16-bit portion thereof) identified by a host address is assigned an internal memory address. In the FIG. 2 example, the internal memory address (IMA) identifies the 32-bit memory location in which each 24-bit pixel (or 8-bit or 16-bit portion thereof) is written. All three 8-bit bytes of a pixel can be assigned the same IMA (to write them into three consecutive columns within a single memory location), or different 8-bit bytes of a pixel can be assigned different IMAs (to write them into different columns of two or more different memory locations).

To compute each internal memory address (IMA), the invention preferably employs two intermediate values called "group" and "block" numbers. A block is a set of X pixels that fully occupies Y memory locations. In the FIG. 2 embodiment, each block includes four pixels, and each block fully occupies three memory locations. The block number is determined by the host address with its four least significant bits removed. Herein, the notation "HA<23:0>" is used to denote the host address of each 24-bit pixel received over the host bus, and "HA<23:4>" denotes the block number of each 24-bit pixel.

In the FIG. 2 embodiment, each pixel address is determined by removing the two least significant bits from the host address. The subscript on each 8-bit byte in FIG. 2 is its pixel memory address (e.g., the 8-bit bytes $R_n$, $G_n$, and $B_n$ together comprise a 24-bit pixel having pixel address "n", which can be stored completely in a single memory location, or partially in each of two memory locations, depending on the value of "n"). The notation "HA<23:2>" denotes the pixel address of each 24-bit pixel.

A "group" number identifies the location of each pixel within a block. Thus, the first pixel in each block in FIG. 2 is group 0, the second pixel in each block in FIG. 2 is group 1, the third pixel in each block in FIG. 2 is group 2, and the fourth and last pixel in each block in FIG. 2 is group 3. The group number of each pixel is determined from the corresponding host address by computing HA<3:2>. The block number for a pixel is determined by dividing the pixel address (HA<23:2>) by four and dropping the remainder. The IMA for each pixel is determined by multiplying the block number by three and then concatenating the result with the group number. These address generation computations are efficiently performed by the circuitry shown in FIG. 11, which is a preferred embodiment of a portion of element 64 of FIG. 10.

The amount of display data stored in the first four memory locations (IMAs) of the conventional memory of FIG. 1 can be stored in only three memory locations of the FIG. 2 embodiment of the memory of the invention. The invention substantially reduces the amount of memory capacity required for refreshing a conventional display, such as a conventional 640×480 display of 24-bit pixels.

The present invention can be implemented by the system shown in FIG. 3. In the FIG. 3 embodiment, host machine 20 transmits an address to calculating device 22. In the preferred embodiment, host 20 is a MACINTOSH computer and calculating device 22 is the "SMT02" product available from SuperMac Technology, Inc. Calculating device 22 receives 32-bit data words (each 32-bit word including a 24-bit pixel) and 32-bit host addresses from host 20. Calculating device 22 transforms each host address into a corresponding internal memory address for writing a 24-bit pixel into memory array 25. The host data, internal memory addresses, and memory access control signals are coupled from calculating device to memory array 25 in order to write compressed host data (i.e., a 24-bit pixel for each 32-bit host data word) into memory array 25 in densely packed fashion. In other words, host 20 provides display data words (and corresponding host addresses) to calculating device 22, which calculates internal memory addresses from the host addresses for writing a portion of each display data word into memory array 25 in densely packed fashion. Display 30 defines an array of pixels, and each display data word portion written into memory array 25 represents a different pixel of display 30 (the display data word portions themselves are sometimes referred to as "pixels"). Memory array 25 has capacity to store a set of the pixels (a "frame" of compressed display data) which determines a binary representation of an image to be formed on display 30. Logic device 26 reads out the contents of memory array 25.

The displayed image is continually updated by reading out the contents of memory array 25. If the displayed image is to be changed, the contents of memory array 25 must first be updated by device 22. During the next display scan cycle after array 25 is updated, the image displayed on display 30 will change accordingly. The contents of individual memory locations within array 25 can be accessed and changed randomly (or in a scan sequence) by host 20 via calculating device 22.

In order to refresh display 30 in a preferred embodiment of the invention, a stream of 32-bit data words representing the contents of consecutively read 32-bit memory locations of array 25 is supplied to logic device 26. Logic device 26 includes means for reformatting the 32-bit words into 24-bit pixels (having conventional format), and circuitry for clocking the 24-bit pixels to RAMDAC 28. RAMDAC 28 converts the 24-bit pixel data into red, green, and blue analog voltage signals for driving display 30.

A preferred embodiment of logic device 26 will be described below with reference to FIG. 13 (in this embodiment, logic device 26 is the "BSR03" product available from SuperMac Technology, Inc.). In this embodiment, logic device 26 reads 32-bit words from densely packed memory array 25 and appropriately separates (unpacks) the 32-bit words into 24-bit pixels. For example, when logic device 26 receives the first 32-bit memory word within a block (bytes $R_0$, $G_0$, $B_0$, and $R_1$ of the first block of FIG. 2), it selects the first three bytes of data (which determine one color pixel) and couples the three selected bytes forming the first pixel to RAMDAC 28. As logic device 26 transmits the selected 24-bit pixel to RAMDAC 28, it retains the fourth byte (which is a portion of a subsequent pixel) in a pixel buffer. FIG. 4 graphically shows this transmission and storage operation performed by logic device 26 as well those described in the subsequent paragraph.

During the next memory access cycle, logic device 26 receives the second memory word within the block (i.e., bytes $G_1$, $B_1$, $R_2$, and $G_2$ of FIG. 2), and couples the retained byte from the previous memory word and the first two bytes of the second memory word to RAMDAC 28. During this cycle, logic device 26 retains the last two bytes of the second memory word (which are a portion of the next 24-bit pixel) in storage. During the next memory cycle, logic device 26 receives the third memory word within the block (i.e., bytes $B_2$, $R_3$, $G_3$, and $B_3$ of FIG. 2) from array 25, and couples the two retained bytes (the two bytes of the second memory word received and retained during the previous cycle), with the first byte of data from the third memory word, to RAMDAC 28. During the next cycle, logic apparatus 26 receives the next 32-bit memory word from array 25, and transmits the three retained bytes (the three bytes of the third memory word received during the previous cycle) to RAMDAC 28. This cyclical process continues until all 32-bit memory words have been read from memory array 25 to logic apparatus 26, and all corresponding 24-bit pixels have been transferred from apparatus 26 to RAMDAC 28, at which time the cycle repeats itself.

FIG. 9 is a block diagram of a preferred embodiment of the invention. The FIG. 9 system supports a 640 pixel by 480 pixel display (not shown in FIG. 9) in which each pixel consists of 24 bit color data (an 8 bit red value, an 8 bit green value, and an 8 bit blue value). To refresh the display, densely packed 32-bit words are read sequentially from frame buffer memory 54 under control of video shift register 56. Video shift register 56 reformats these words into 24-bit pixels, and supplies the 24-bit pixels to RAMDAC circuit 12. RAMDAC 12 (which is identical to RAMDAC 12 of FIG. 8) converts the pixels into voltage values for driving the display device. The display is refreshed at a desired rate, typically in the range from 25 times per second to over 85 times per second. The process of reading pixels from the frame buffer memory to repaint the display screen is known as a "display refresh" operation.

Graphics controller 52 shown in FIG. 9 receives 32-bit video data over bus 1 from a host computer (not shown in FIG. 9), and controls the writing of 24-bit color pixels of the 32-bit data to frame buffer memory 54, for densely packed storage in memory 54. Graphics controller 52 (which is preferably the "SMT02" product available from SuperMac Technology, Inc.) assumes that 24 bits (typically the 24 least significant bits) of each 32-bit word received over bus 1 represents a color pixel, and asserts appropriate memory address signals, and control signals (including row address strobe signals RAS2 and RAS3 and column address strobe signals) to memory 54 to latch each color pixel into memory 54 in densely packed fashion.

Graphics controller 52 also asserts appropriate address and control signals to memory 54 and video shift register 56, to perform a display refresh operation.

In the FIG. 9 system, frame buffer 54 comprises VRAM circuitry having a total capacity of 256K×32 bits, and has capacity to hold all the 24-bit pixels that are needed to update a 640×480 pixel color display (i.e., 307,200 values, each consisting of 24 bits). In a preferred embodiment, frame buffer 54 consists of eight, identical, 128K×8 bit VRAM chips (VRAM circuits 90, 91, 93, 94, 96, 97, 99, and 100), and each video VRAM has an associated shift register (circuits 92, 95, 98, and 101) for receiving data that are read out from the VRAM chips. This represents a 33% reduction in the number of such VRAM chips required to support this type of color display, relative to the conventional system described above with reference to FIG. 8, which requires twelve 256K×4 bit chips to support such a color display. VRAM chips 90, 93, 96, and 99 comprise a first "bank" of memory 54, and VRAM chips 92, 95, 98, and 101 comprise a second "bank" of memory 54. Row address strobe signals RAS2 and RAS3 from graphics controller 52 select between the first and second memory banks.

Figure 8:
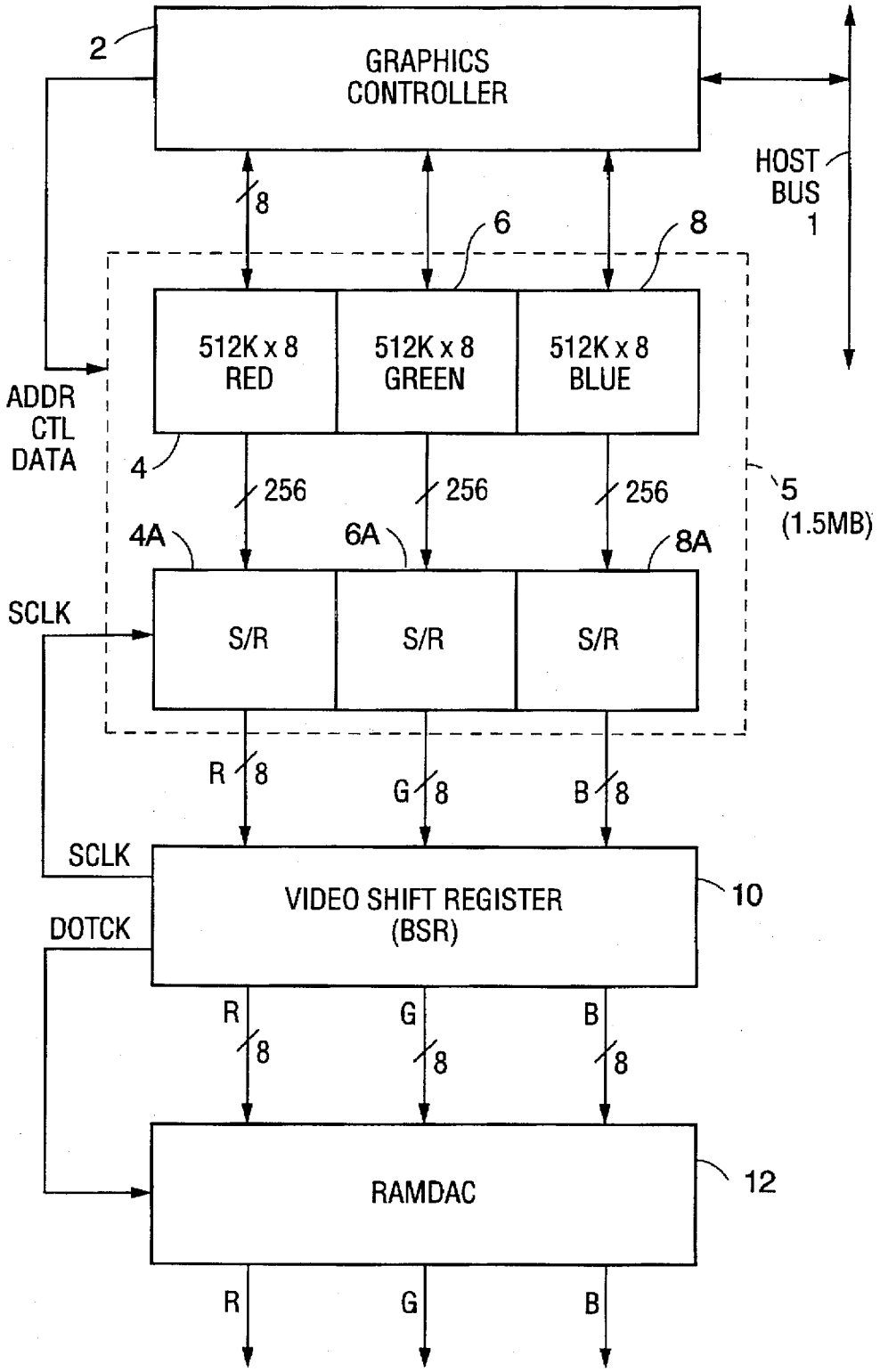
FIG. 8 (PRIOR ART)
FIG. 8 is a block diagram of a conventional graphics system.
Figure 8A:
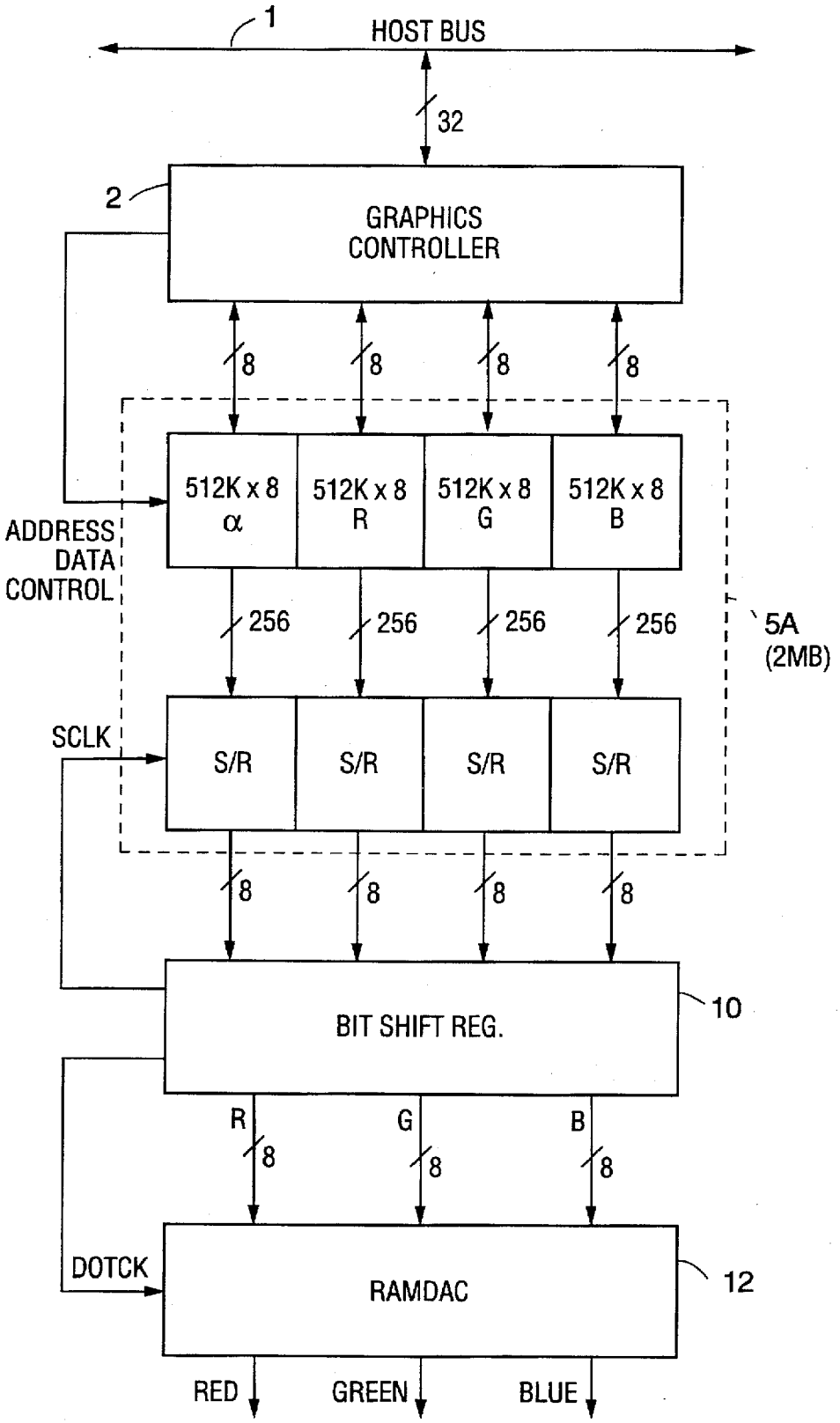
FIG. 8A (PRIOR ART)
FIG. 8A is a block diagram of another conventional graphics system.
Figure 15:
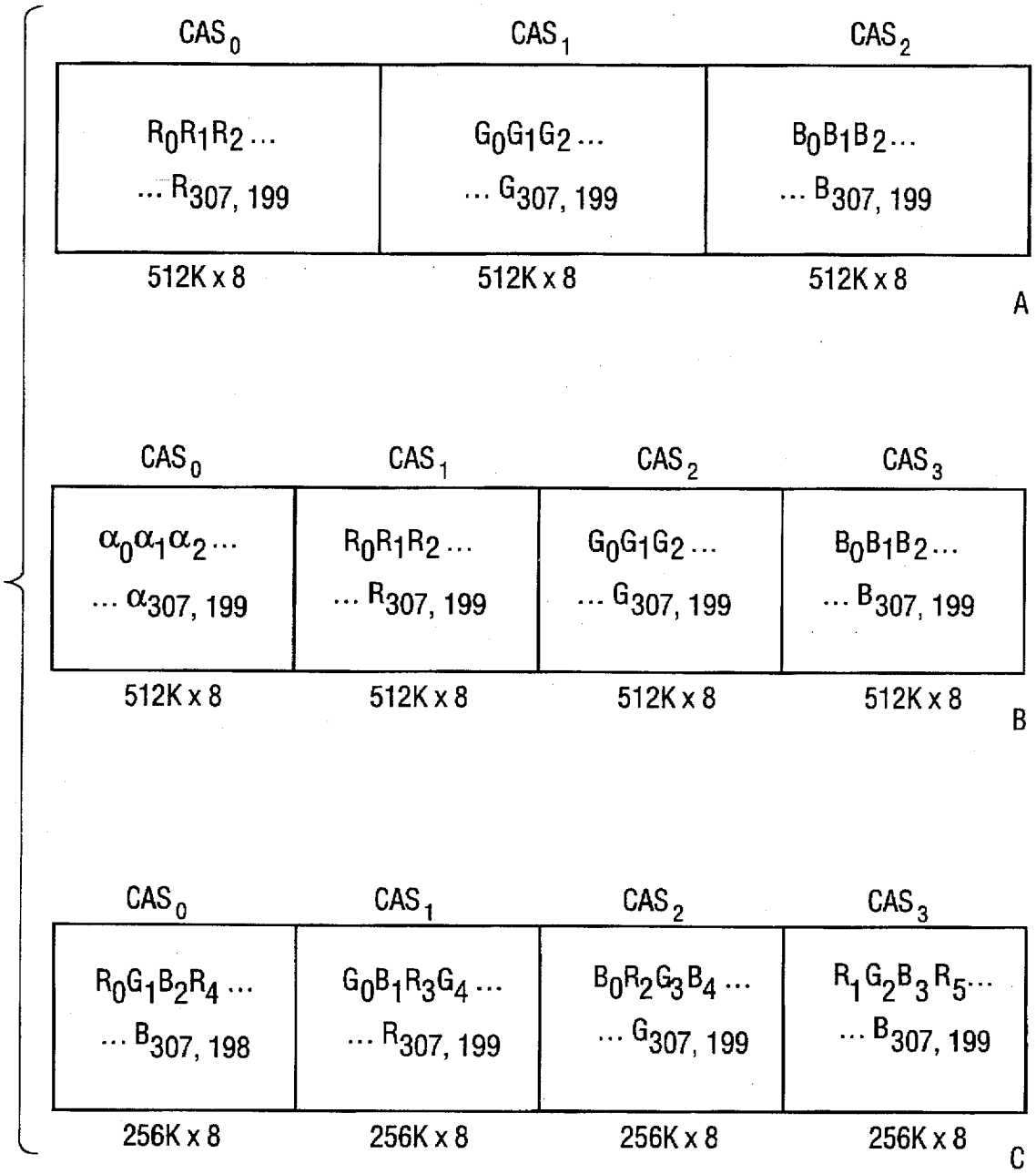
FIG. 15 is a diagram representing the memory organizations of the frame store of each of FIGS. 8, 8A, and 9.

In FIG. 15, memory "C" represents the organization of memory 54 of FIG. 9, memory "B" represents the organization of memory 5A of FIG. 8A, and memory "A" represents the organization of memory 5 of FIG. 8. As is apparent from FIG. 15, in memory 54 of FIG. 9, VRAM chips 90 and 91 correspond to column CAS0, and store 230,400 bytes of densely packed red, green, and blue bytes, VRAM chips 93 and 94 correspond to column CAS1, and store 230,400 bytes of densely packed red, green, and blue bytes, VRAM chips 96 and 97 correspond to column CAS2, and store 230,400 bytes of densely packed red, green, and blue bytes, and VRAM chips 99 and 100 correspond to column CAS3, and store 230,400 bytes of densely packed red, green, and blue bytes. This efficient memory organization is in striking contrast to that of memory 5 of FIG. 8, in which VRAM circuit 4 corresponds to column CAS0 and stores 307,200 bytes of non-densely packed red bytes, VRAM circuit 6 corresponds to column CAS1 and stores 307,200 bytes of non-densely packed green bytes, and VRAM circuit 8 corresponds to column CAS2 and stores 307,200 bytes of non-densely packed blue bytes. It also contrasts with the inefficient use of memory 5A of FIG. 8A, in which one 512K×8 bit VRAM circuit (corresponding to column CAS0) stores 307,200 bytes of non-densely packed alpha bytes, a second 512K×8 bit VRAM circuit corresponds to column CAS1 and stores 307,200 bytes of non-densely packed red bytes, a third 512K×8 bit VRAM circuit corresponds to column CAS2 and stores 307,200 bytes of non-densely packed green bytes, and a fourth 512K×8 bit VRAM circuit corresponds to column CAS3 and stores 307,200 bytes of non-densely packed blue bytes.

Conventional VRAM circuits suitable for implementing 256K×32 bit frame buffer 54 have two data ports. The first is a random access port that allows access to any location by the host, while the second port is a video port that provides sequential access from a starting location. The FIG. 9 apparatus employs the video port of each of VRAM circuits 90, 91, 93, 94, 96, 97, 99, and 100 for supporting display refresh. 256-bit data from the video ports of circuits 90 and 91 are transferred to shift register portion 92 of circuits 90 and 91 (and 8-bit bytes of the data are transferred sequentially from register 92 to video shift register 56), 256-bit data from the video ports of circuits 93 and 94 are transferred to shift register portion 95 of circuits 93 and 94 (and 8-bit bytes of the data are transferred sequentially from register 95 to video shift register 56), 256-bit data from the video ports of circuits 96 and 97 are transferred to shift register portion 98 of circuits 96 and 97 (and 8-bit bytes of the data are transferred sequentially from register 98 to video shift register 56), and 256-bit data from the video ports of circuits 99 and 100 are transferred to shift register portion 101 of circuits 99 and 100 (and 8-bit bytes of the data are transferred sequentially from register 95 to video shift register 56). Video shift register 56 provides support for unpacking the densely packed pixels read from frame buffer 54 prior to providing the unpacked pixels to RAMDAC 12.

Figure 10:
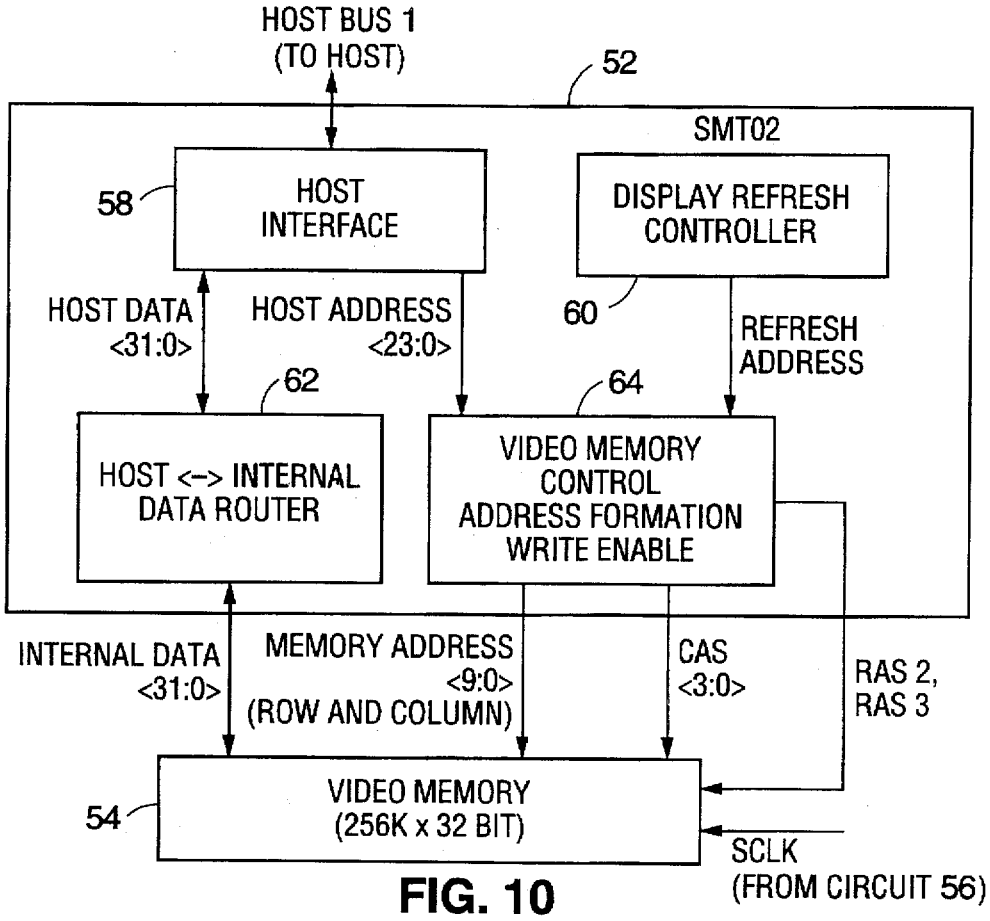
FIG. 10 is a block diagram of the graphics controller and frame buffer memory portions of the FIG. 9 apparatus.

A preferred embodiment of graphics controller 52 will next be described with reference to FIG. 10. In the FIG. 10 embodiment, graphics controller 52 is the above-mentioned SMT02 integrated circuit product available from SuperMac Technology, Inc., and includes the following circuits (connected as shown in FIG. 10): bus interface 58, display refresh controller 60, host-to-internal data router 62, and memory controller 64.

Bus interface 58 handles all transactions between the host and the inventive graphics apparatus. It receives the host addresses and transfers the corresponding data between host bus 1 and circuits 62 and 64. Bus 1 can be a conventional NUBUS bus (to be denoted herein as a "NUBUS"), or can be conventional processor direct slot (PDS) of an APPLE MACINTOSH computer. (NUBUS is a trademark of Texas Instruments.) Although, for specificity in describing FIG. 10, we next describe an embodiment of graphics controller 52 apparatus in which bus 1 is a conventional NUBUS, it should be appreciated that alternative embodiments of graphics controller 52 can interface with a PDS.

In this embodiment, the host believes that it is addressing a linear array of 24-bit pixels, each in a 32-bit "container." In other words, each 32-bit word transferred from host bus 1 (which is a NUBUS in the embodiment being described) to interface 58 has format XRGB, where X is a wasted 8-bite byte having a host address N, and R, G, and B (having host addresses N+1, N+2, and N+3, respectively) together represent a 24-bit pixel.

More specifically, the memory addresses on NUBUS 1 for graphics data (the host addresses) have form 1111 SSSS xxxx xxxx xxxx xxxx xxxx xxxx where S represents the 4 bit address of a NUBUS card (the FIG. 9 apparatus). Each "x" represents a binary number, so that the address is 32 bits long. In the context of the present invention, the addresses are used to refresh a display with 24-bit color (RGB) data.

The NUBUS architecture provides 4 GBytes of address space. The upper one-sixteenth (256 MBytes) of the NUBUS address space is called slot space which is divided into 16 regions of 16 MBytes. Each region has one slot identifier. For APPLE MACINTOSH applications, NUBUS slot address S=0000 through 1000 are unused. When a MACINTOSH II card on the NUBUS needs more than 16 MBytes, it can access the super slot space between 1001 0000 0000 0000 0000 0000 0000 0000 and 1110 1111 1111 1111 1111 1111 1111 1111. The super slot space is divided into regions of 256 MBytes each.

Display refresh controller 60 generates all of the video timing necessary to maintain continuous display refreshes. It also generates the memory addresses (the "Refresh Address" indicated in FIG. 10) needed to read pixels from the video data ports of the VRAMs comprising frame buffer 54.

Data router 62 receives the 32-bit host data from bus interface 58 and performs the data routing operation needed to support host accesses of 24-bit pixels in 32-bit frame buffer 54.

Memory controller 64 receives the Host Address signals from bus interface 58 (the host addresses) and the Refresh Address signals from display refresh controller 60, and generates all the memory accesses to frame buffer 54 for both host access and display refresh. It performs the translation between the host addresses and internal memory addresses ("IMAs"), converts the IMAs into memory addresses (by decomposing the IMAs into row and column components), and asserts the memory addresses to frame buffer 54. It also generates the write enables (and corresponding CAS signals) needed to support host writes of 24-bit pixels into 32-bit wide frame buffer 54.

To generate the proper IMA from the incoming host address, memory controller 64 generates the block number (the quantity "HA<23:4>" described above with reference to FIG. 2) of the host address received from bus interface 58 (the least significant 24 bits of the host address received over bus 1, from which host address the most significant bits "1111 SSSS" have been discarded), multiplies the block number by three, and concatenates the product with the group number (the quantity "HA<3:4>" described above with reference to FIG. 2).

Figure 11:
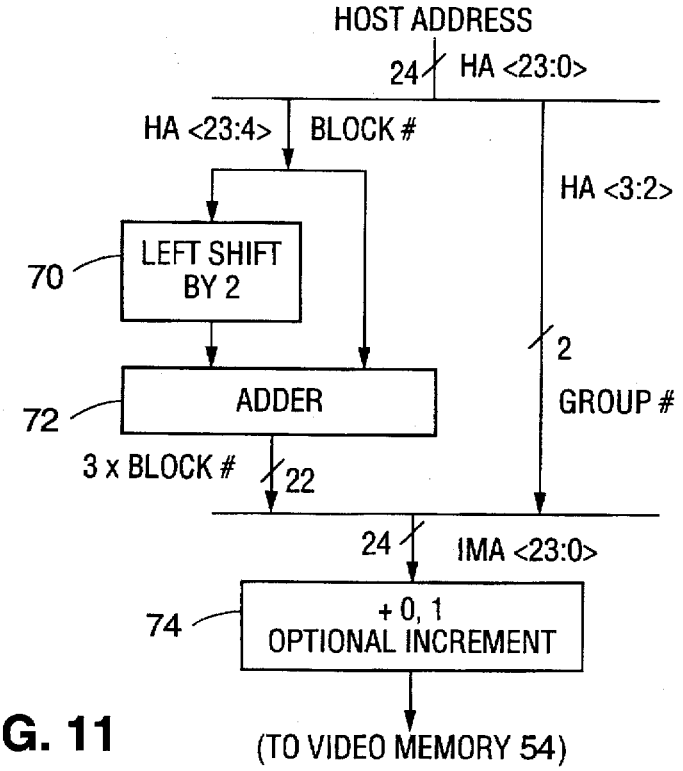
FIG. 11 is a block diagram of a portion of the FIG. 10 apparatus.

Memory controller 64 preferably includes circuits 70 and 72 (connected as shown in FIG. 11) for performing these operations. Additions are typically more efficiently implemented in digital circuitry than multiplications, and multiplication by two merely requires shifting the decimal place of the binary value. Thus, to multiply the block number by three, multiplier circuit 70 multiplies the block number by two, and addition circuit 72 then adds the block number to the output of circuit 70. The output of circuit 72 is concatenated with the group number.

It is an important aspect of the invention that the conversion of the host address to the IMA is performed in a manner which does not degrade performance (when compared to conventional systems, that do not densely pack pixels into a frame memory). This is done by overlapping the address conversion (performed by circuit 64) with the actual host data transfer. Any host access consists of a host address transferred on host bus 1 followed by data transferred on host bus 1. The conversion from the host address to the IMA is preferably done during the address transfer on host bus 1.

To implement dense packing of pixels in the memory locations of frame buffer 54 (as described above with reference to FIG. 2), a pixel is often split between two memory addresses (so that portions of the pixel reside in two different memory locations). During a host access to such a pixel, two reads or writes are required. This is determined by the group number of the pixel (described above with reference to FIG. 2). Pixels in groups 1 and 2 require two memory accesses, while pixels in groups 0 and 3 require only one. For this reason, memory controller 64 preferably includes optional address incrementing circuit 74 (shown in FIG. 11), which adds one to the IMA for the second memory access of each pixel in group 1 or 2 (each pixel having portions which reside in two memory locations within frame buffer 54).

During writes, each column of frame buffer 54 is individually enabled for writing. The write enables are also determined by the group number. The actual write enabling is done using the column address strobe (CAS) signals supplied from memory controller 64 to frame buffer 54 (which is implemented with VRAM chips that require row and column address strobes). When a CAS line to a particular column is not fired during a write, the column is not written. The use of CAS lines to enable and disable writes to a memory is well known in the art and will not be further elaborated upon. For pixels in groups 1 and 2 for which two writes are required for a complete memory access, a different write enable is needed for each write.

As mentioned above, the host always provides and receives 32-bit data words in the format XRGB, where X is a "don't care" byte comprising the most significant bits transferred on host bus 1. The format of each pixel in frame buffer 54 depends on the group number. Data router 62 performs the required data format conversion from the host format to the frame buffer ("internal") format. The conversion is controlled by the group number of the pixel being accessed. FIG. 12 is a table which shows the number of memory access cycles, the write enables asserted, and the data organization, as a function of group number.

Figures 12, 13:
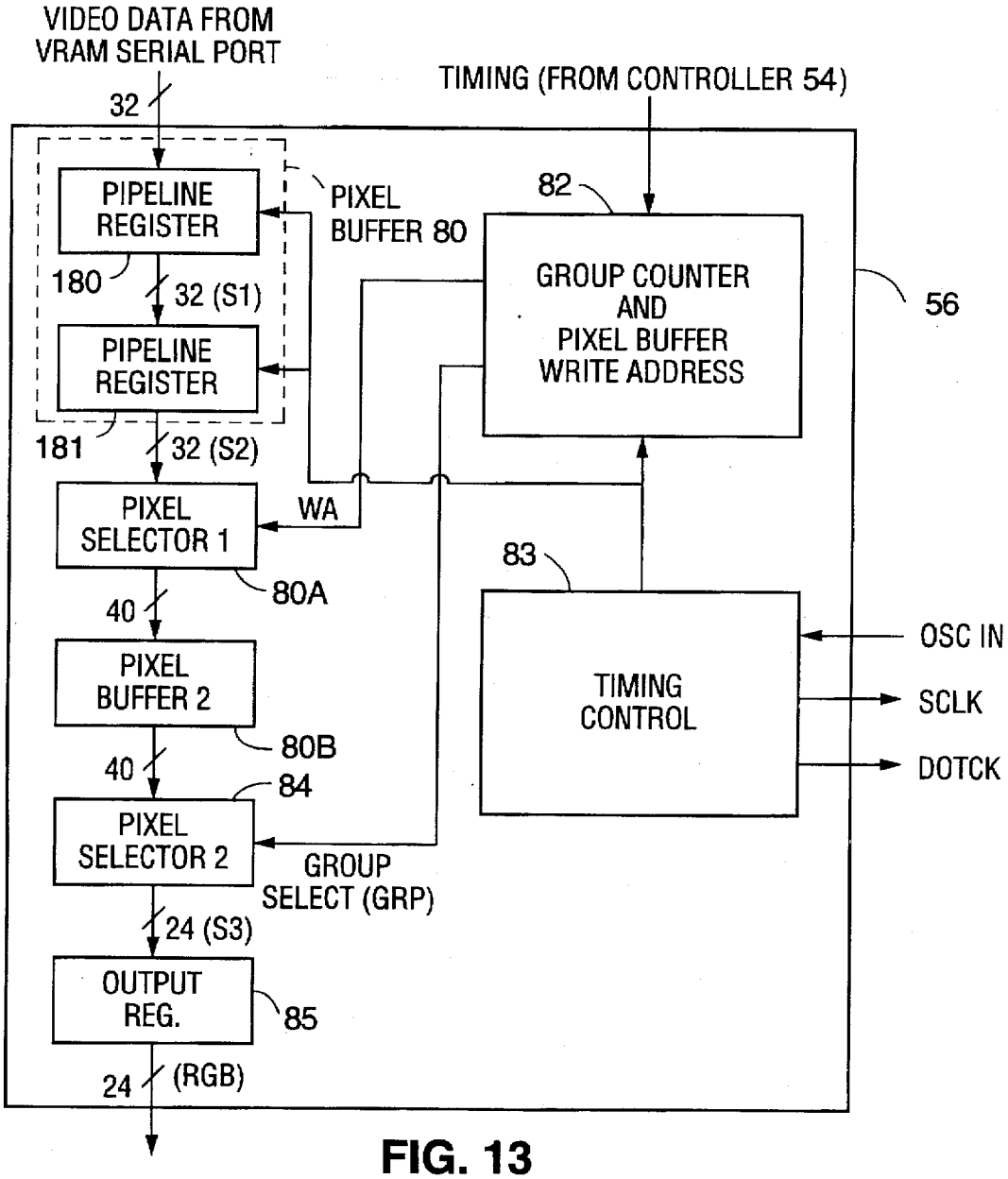
FIG. 12 is a diagram representing signals generated during operation of the FIG. 10 apparatus.
FIG. 13 is a block diagram of the video shift register portion of the FIG. 9 apparatus.
Figures 12, 13:
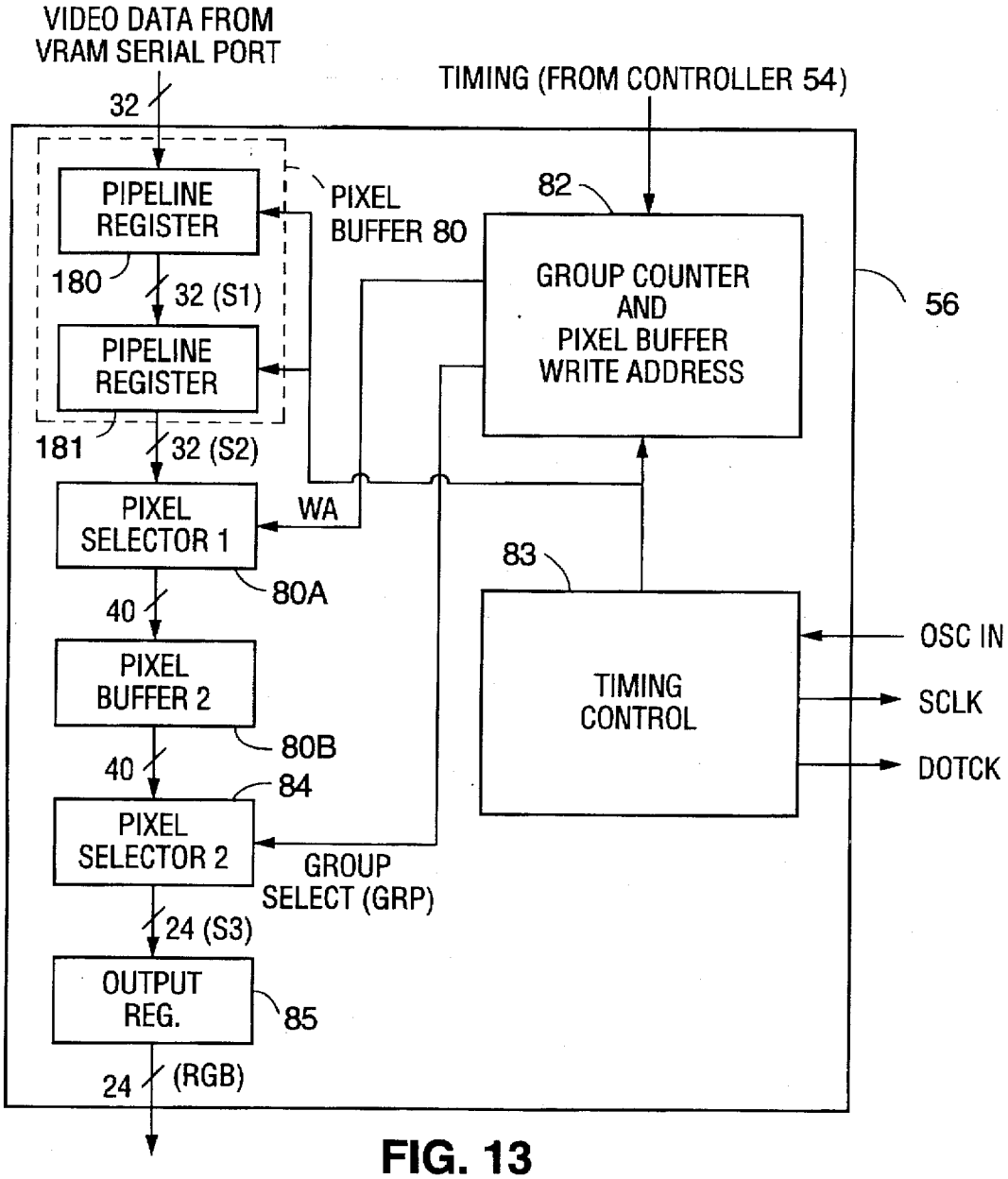

As indicated in FIG. 12, when a pixel is written to group 1 or 2 within a block in the frame buffer, portions of the pixel are written to different memory locations, and thus two memory cycles (and two sets of write enables) are needed to perform the write. When the write is to group 0 or 3 (within a block in the frame buffer), only a single write is needed and only one set of write enables are required. During writes of a pixel by the host, only three bytes (which define a color pixel) must be written into the frame buffer memory. This requires that only three of the columns of the frame buffer be written.

Each write enable is a signal consisting of four binary bits. Each one of these bits whose value is one indicates that a write should occur to a corresponding column, while each one of the bits whose value is zero indicates that no write should occur. The first bit in the four-bit write enable signal is for column 0 and the last bit is for column 3. During a write, the write enables are used to enable or disable the CAS signal to their corresponding columns. When a CAS is not asserted to a column during a write, the write is disabled.

Display refresh controller 60 (shown in FIG. 10) generates all the timing signals necessary to maintain continuous display refreshes, and generates the memory addresses needed to read video data from the video port of each VRAM of frame buffer 54. Each VRAM allows a sequential stream of pixels to be shifted out of its video port under the control of a Shift Clock signal (SCLK) received from timing control circuit 83 of circuit 56. The pixels are shifted from a shift register embedded in the VRAM that is loaded from the VRAM memory by a special memory cycle called a data transfer cycle. It is well known in the art how to construct a display system using VRAM circuits, and so no further details of such VRAM circuitry will be described. Controller 60 generates the memory addresses to be used for the transfer cycles.

Each pulse of the shift clock (signal SCLK) shifts a 32-bit value from a memory location within frame buffer 54 to a pixel buffer (buffer 80 shown in FIG. 13) within video shift register circuit 56. Since a single pixel consists of 24 bits, the shift clock has fewer rising edges per second than the pixel clock (signal "OSCin" shown in FIG. 14) employed to clock the pixels from circuit 56 into RAMDAC circuit 12. In accordance with the invention, the shift clock is generated from the pixel clock by dropping (suppressing) every fourth pulse of the pixel clock, as indicated by the timing diagram set forth as FIG. 14.

A preferred embodiment of video shift register circuit 56 will next be described with reference to FIG. 13. In this embodiment, circuit 56 is the "BSR03" bit shift register product available from SuperMac Technology, Inc. As indicated in FIG. 13, pixel buffer 80 sequentially receives "densely packed" 32-bit values from successive memory location within frame buffer 54. Buffer 80 has capacity to pipeline an entire block of data from frame buffer 54 (each block consists of four 24-bit color pixels). Buffer 80 includes pipeline register 180 which receives 32-bit words (parallel data S1) from frame buffer 54, and pipeline register 181 which receives 32-bit words (parallel data $2) from register 180.

The output (S2) of pipeline register 181 is transferred to pixel selector 80A. The output of pixel selector 80A is transferred to pixel buffer 80B. The output of pixel buffer 80B is transferred to pixel selector 84. The output of pixel selector 84 is transferred to output register 85.

Group counter and pixel buffer write address circuit 82 within circuit 56 is controlled by a combination of timing signals from graphics controller 54 and timing signals generated within timing control circuit 83 in response to externally supplied oscillator "OSCin"), and keeps count of the current group to be output from circuit 56. Circuit 82 generates a pixel buffer write address (WA), and asserts address WA to pixel selector 80A. Selector 80A has 40-bit width. Signal WA determines the positions within selector 80A to which each byte of each 32-bit word from register 181 is to be written.

Pixel selector 84 (which can be a multiplexer circuit) responds to the group number signal ("group select" or "GRP") asserted by circuit 82 by selecting a 24-bit pixel (parallel data S3) from the pixel data currently stored in pixel buffer 80B. The selected 24-bit pixel asserted at the output of pixel selector 84 is received by output register 85 and is then driven from register 85 to RAMDAC 12.

FIG. 14 is a timing diagram that shows when densely packed frame buffer video data (the "VRAM Output" in FIG. 14) are pipelined through pixel buffer 80 (as signals S1 and S2). FIG. 14 also shows when the pixel buffer write address (signal WA in FIG. 13) and group select signal (signal GRP in FIG. 13) are generated, and the timing with which unpacked 24-bit pixels (S3) are read into output register 85 of FIG. 13 and then read out (as the "Output of Register 85") from output register 85. Pixel clock signal DOTCK (of FIG. 13) and shift clock signal SCLK (of FIGS. 13 and 14) are generated within circuit 83 from external oscillator "OSCin" (DOTCK is simply a 180-degree phase-shifted version of OSCin). On the rising edge of each group of four cycles of oscillator "OSCin," the group select signal GRP is reset to zero. On each of the subsequent rising edges of OSCin (in each group of four cycles), GRP is incremented (from zero to one, from one to two, and finally from two to three). On the first rising edge of shift clock SCLK in each group of three closely spaced rising edges of SCLK (e.g., on the rising edge of the second pulse of shift clock SCLK in FIG. 14), the pixel buffer write address (WA) is set to "zero." WA is set to "one" on the second shift clock rising edge (in each set of three), and WA is set to "two" on the third shift clock rising edge (in each set of three). Output register 85 captures the output of pixel selector 84 on each rising edge of signal OSCin.

Figure 5:
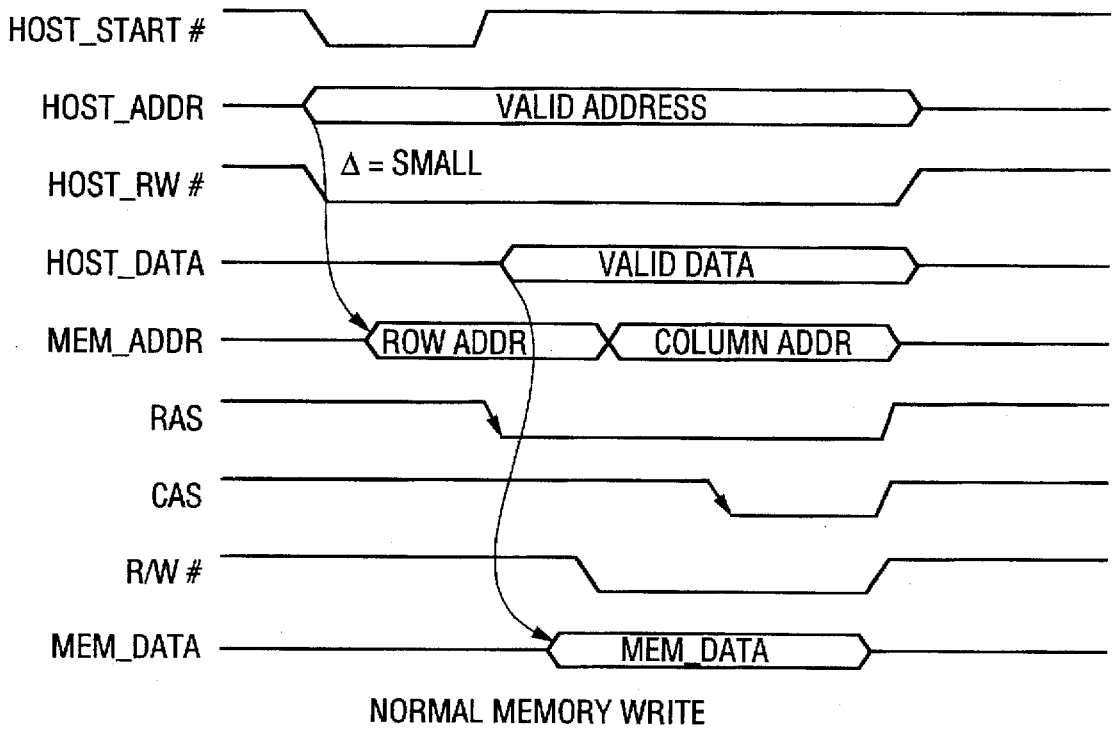
FIG. 5 (PRIOR ART)
FIGS. 5 and 6 are timing diagrams of a conventional memory write and read cycle, respectively.

Consider next the timing diagram set forth in FIG. 5 for a memory write cycle of a conventional system of the type shown in FIG. 8. With reference to the top waveform in FIG. 5, the host issues a start signal, a valid memory address, and appropriate control signals all at about the same time. The valid address is applied to the system's video memory, first as a row address and then as a column address. When the row address is valid, a row address strobe (RAS) is applied and when the column address is valid, a column address strobe (CAS) is applied. The row address is usually valid well before the row address strobe RAS is enabled. A read/write signal is applied to the memory in conjunction with the CAS in order to latch the data into the memory.

Figure 6:
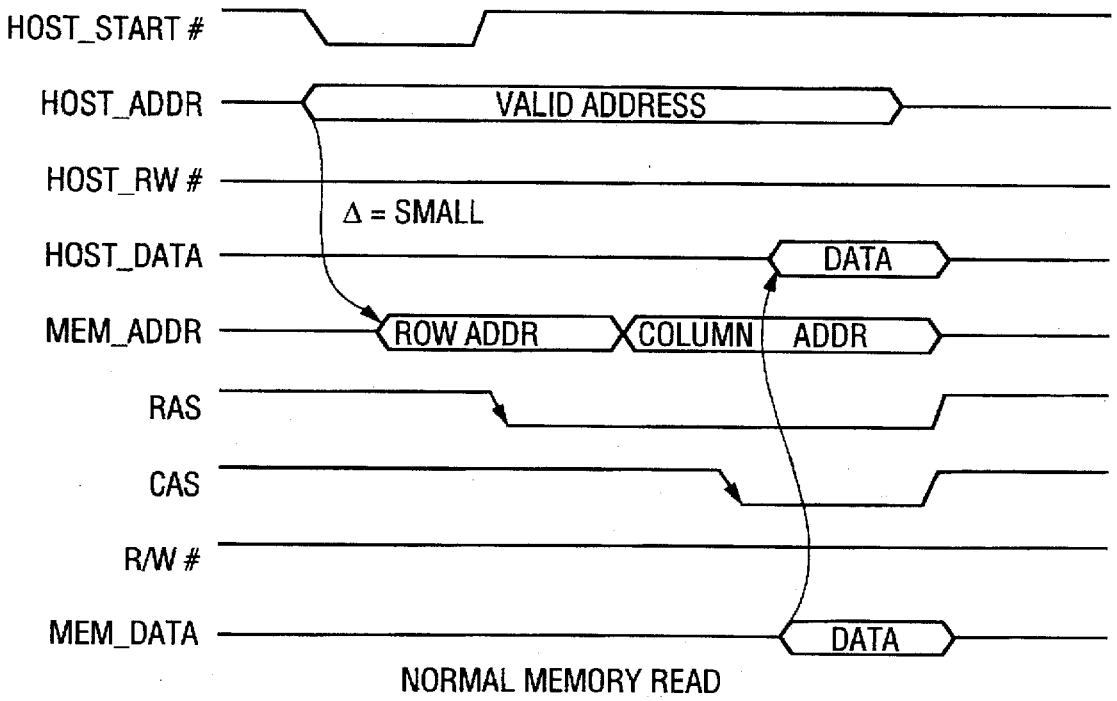
FIG. 6 (PRIOR ART)

Similarly, FIG. 6 shows the timing diagram for a memory read cycle of a conventional system of the type shown in FIG. 8. The host issues a start signal and valid memory address at about the same time. The address is latched to the video memory first as a row address and then as a column address. The row address is usually valid well before the row address strobe RAS is enabled, as in FIG. 5. The RAS signal is active during the row address valid time and the CAS signal is valid during the column address valid time to latch the row and column addresses. The corresponding stored data are coupled to the output of the video memory and are available to the host.

Figure 7A:
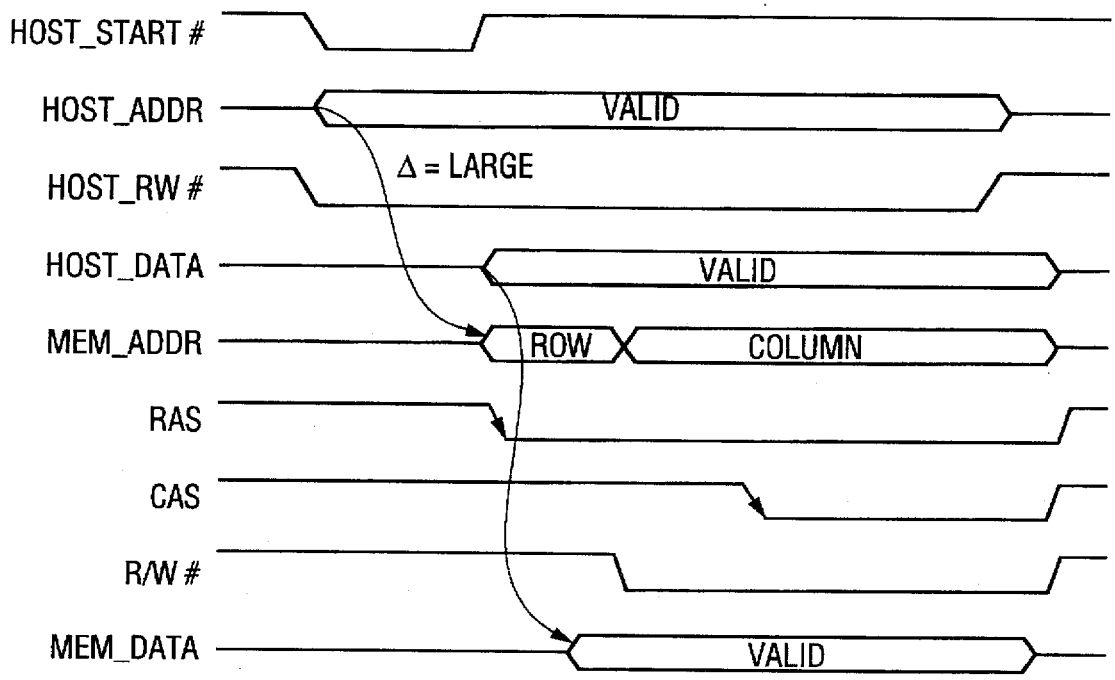
FIGS. 7A and 7B are timing diagrams of a memory write and read cycle, respectively, according to the present invention.

In contrast with FIG. 5, FIG. 7A shows a memory write cycle according to the present invention. Only the differences between the prior art method represented by FIG. 5 and the FIG. 7A embodiment of the inventive method will be discussed below. In FIG. 7A, the row address is not immediately valid after the host address is available. This is because the appropriate IMA must be calculated from the host address (and the memory address derived from the IMA). In the FIG. 7A embodiment, the row address is available a very short time before the RAS signal is enabled.

Figure 7B:
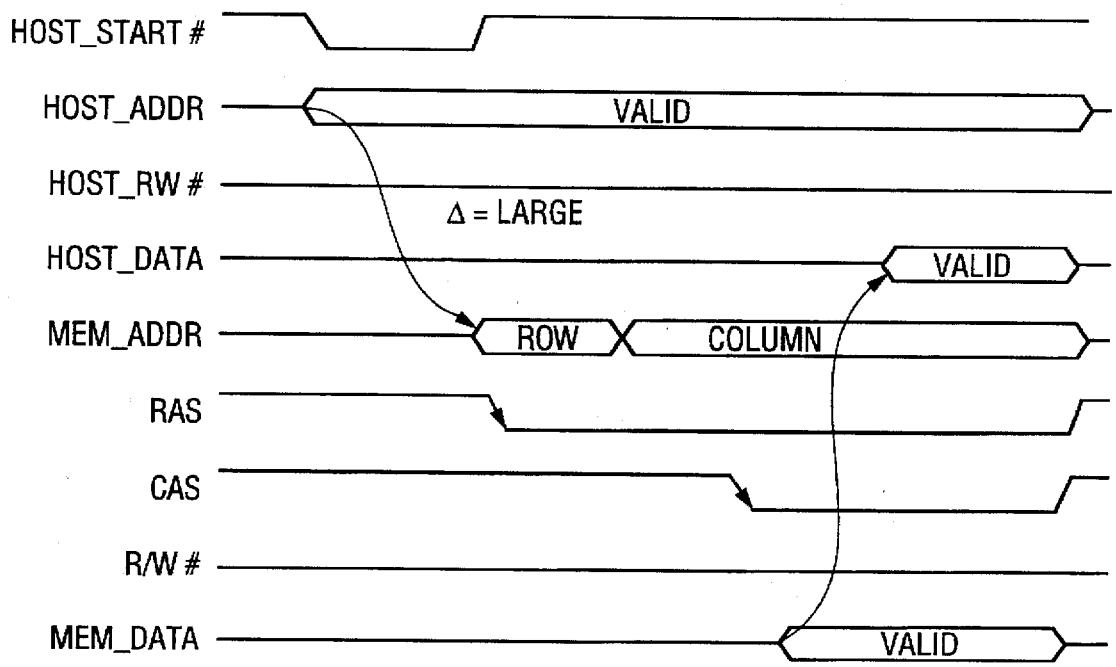

In contrast with FIG. 6, FIG. 7B shows the timing diagram of a memory read cycle according to the present invention. Like the memory write cycle of FIG. 7A, the internal memory address (IMA) is not immediately valid after the host address is available, but the row address is available before the RAS signal is enabled. Note that in the inventive memory write and memory read cycles of FIGS. 7A and 7B, the RAS signals are enabled at the same time (with respect to the beginning of the host cycle) as in the corresponding prior art methods of FIGS. 5 and 6.

In the methods of FIGS. 7A and 7B, the host address to IMA conversion calculation is performed asynchronously by combinational logic circuits. Because the calculation is performed asynchronously, rather than synchronously, the calculation can occur at its own speed rather than in synchronization with other operations or the clock of the system. The combinational logic of the invention (which can be embodied in calculating circuit 22 of FIG. 3) is preferably designed so that the calculation occurs very swiftly. In particular, the calculation occurs sufficiently rapidly that there is no negative impact on system performance. In other words, the RAS strobe occurs at the same time in a read or write cycle (with respect to the host initiation) whether or not graphics data from the host are compressed for dense packing in video memory according to the present invention. The inventive system can be operated in a compressed mode (in which each data word from the host is compressed for dense packing in a video memory) or a non-compressed mode (in which the data words from the host are not compressed prior to storage in the video memory). Preferably, the system of the invention can access the memory in the compressed mode at substantially the same speed as in the non-compressed mode.

The present invention can be implemented, in a manner that will be apparent from the present disclosure to those of ordinary skill in the art, to graphics systems which store pixels other than 24-bit pixels in a video memory, or which employ a video memory having memory locations of width other than 32 bits. The invention is particularly suited to situations in which data words received from a host have a different number of bits than do the memory locations of a video memory to which they are written to support display refresh operations (e.g, in situations in which at least some of the host data words must be written into more than one memory word, in order to densely pack the video memory). For example, the invention can be embodied in a graphics system in which host image data comprising 20-bit pixels are densely packed into 25-bit memory locations in a frame buffer memory, to support display refresh operations.

The invention can be applied to situations in which each host data word is longer than each memory location (for example, where each host data word is 21 bits long and each memory location consists of 18 bits).

The graphics system of the invention densely packs graphic data into a memory, where the memory locations have different length than the length of each word of the graphics data. The invention performs a host address to internal memory address conversion calculation asynchronously to generate an internal memory address (and then a memory address and appropriate memory strobes) for each of a set of compressed data words, within the parameters of a system which writes the graphics data words into memory without compressing them. Thus, the graphics controller of the invention is operable in the above-described mode in which it rapidly and asynchronously generates internal memory addresses from the host addresses for densely packing data words into memory locations (a "compressed" storage mode, such as that described above with reference to FIG. 9), and is also operable in a conventional mode (a "non-compressed" storage mode, such as that described above with reference to FIG. 8A) in which it stores host data words in memory locations determined by host addresses, and can access the memory at essentially the same speed in both the compressed mode and in the non-compressed mode.

Modifications which become apparent to one of ordinary skill in the art only after reading this disclosure are deemed within the scope of the present invention.

What is claimed is:

1. A system for controlling a graphics display, comprising:

a frame store having memory locations, wherein the memory locations have a fixed correspondence with an array of pixels. Wherein each of the memory locations has a capacity to store a first number of bits; and a control means for writing data words into the memory locations, wherein each of the data words corresponds to one of the pixels and comprises a second number of bits, where the second number is different than the first number and wherein the control means includes means for writing a first portion of one of the data words into a first one of the memory locations and a second portion of the said one of the words into a second one of the memory locations, wherein the second number is less than the first number, wherein the control means includes means for writing M of the data words into a memory block consisting of N of the memory locations, where N<M, wherein the memory block has a block number, and wherein the control means includes:

means for receiving host words and a host address for each of the host words, wherein each of the data words is a portion of one of the host words;

means for generating a group number for each of the data words to be written into the memory block from the host address corresponding to said each of the data words, where the group number is a set of bits indicative of an integer not less than zero and not greater than M−1;

means for generating internal memory addresses for portions of the host words from the host addresses corresponding to the data words, by multiplying the block number by three to generate product bits, and concatenating the product bits with the group number; and means for selectively writing a portion of each of the host words to a selected one of the memory locations determined by the internal memory address for said each portion of said each of the host words.

2. The system of claim 1, wherein the means for generating internal memory addresses executes a pair of address generation cycles for one of the data words having a particular group number, and includes an address incrementing means for incrementing, during a second one of each said pair of address generation cycles, the internal memory address generated during a first one of each said pair of address generation cycles.

3. A method for controlling a graphics display, including the steps of:

receiving host words and host addresses for the host words, wherein each of the host words includes a data word comprising X bits, wherein each said data word corresponds to a pixel of the display;

generating an internal memory address from each of the host addresses; and selectively writing each of the data words to a selected memory location determined by the internal memory address corresponding to said each of the data words, wherein the memory locations have a fixed correspondence with an array of pixels of the display, and wherein each of the memory locations has a capacity to store Y bits, where X is a first number and Y is a second number different than the first number, wherein the second number is greater than the first number, also including the steps of:

writing M of the data words into a memory block consisting of N of the memory locations, where N<M, wherein the memory block has a block number;

generating a group number for each of the data words stored in the memory block from one of the host addresses, where the group number is a set of bits indicative of an integer not less than zero and not greater than M−1; and generating an internal memory address from each of the hose addresses corresponding to the data words stored in the memory block, by multiplying the block number by three to generate product bits, and concatenating the product bits with the group number.

4. A video graphic display system comprising:

a display having N pixels consecutively arranged in a sequence;

a graphics memory coupled to provide data to the display, said memory having M memory locations each having a first number of bits, where M is less than N, wherein the memory locations have a fixed correspondence with the pixels of the display; and a control means operable in a compressed mode for storing N data words in the memory locations, each of the data words having a second number of bits and containing information for displaying a different one of the pixels;

wherein the control means includes means for asynchronously densely packing the data words in the memory locations, and wherein the system also includes:

means for reading the data words from the memory locations and asserting the data words read from the memory locations in said sequence one at a time.

5. A video graphic display system comprising:

a display having N pixels consecutively arranged in a sequence;

a graphics memory coupled to provide data to the display, said memory having M memory locations each having a first number of bits, where M is less than N, wherein the memory locations have a fixed correspondence with the pixels of thee display; and a control means operable in a compressed mode for storing N data words in the memory locations, each of the data words having a second number of bits and containing information for displaying a different one of the pixels, wherein the control means includes:

means for writing X of the data words into a memory block consisting of Y of the memory locations, where Y<X, <X, wherein the memory block has a block number;

means for receiving host words and a host address for each of the host words, wherein each of the data words is a portion of one of the host words;

means for generating a group number for each of the data words to be written into the memory block from the host address corresponding to said each of the data words, where the group number is a set of bits indicative of an integer not less than zero and not greater than M−1;

means for generating an internal memory address from the host address corresponding to said each of the data words, by multiplying the block number by three to generate product bits, and concatenating the product bits with the group number; and means for selectively writing a portion of each of the host words to a selected one of the memory locations determined by the internal memory address for said each portion of said each of the host words.

6. A video graphic display system comprising:

a display having N pixels consecutively arranged in a sequence;

a graphics memory coupled to provide data to the display, said memory having M memory locations each having a first number of bits, where M is less than N, wherein the memory locations have a fixed correspondence with the pixels of the display; and a control means operable in a compressed mode for storing N data words in the memory locations, each of the data words having a second number of bits and containing information for displaying a different one of the pixels;

wherein the control means is also operable in a non-compressed mode for storing M data words in the memory locations, with one of the data words stored in each of the memory locations, wherein the control means can access the graphics memory at substantially the same speed in the non-compressed mode and in the compressed mode.

* * * * *